United States Patent [19]

Reed, III

[11] Patent Number: 4,767,162

[45] Date of Patent: Aug. 30, 1988

[54] BLADE CONTROL SYSTEM FOR CONCRETE CUTTING APPARATUS

[75] Inventor: Charles W. Reed, III, Raytown, Mo.

[73] Assignee: Federal-Mogul Corporation, Southfield, Mich.

[21] Appl. No.: 6,521

[22] Filed: Jan. 23, 1987

[51] Int. Cl.[4] ..... E21C 25/16

[52] U.S. Cl. ..... 299/1; 299/39

[58] Field of Search ..... 299/39, 1; 404/90; 91/47, 307; 251/263; 83/639

[56] References Cited

U.S. PATENT DOCUMENTS

| | | | |
|---|---|---|---|
| 2,858,650 | 11/1958 | Janowitz | 299/39 |
| 2,974,938 | 3/1961 | Lewis | 299/39 |
| 3,208,796 | 9/1965 | Hatcher | 299/39 |
| 4,310,198 | 1/1982 | Destree | 299/39 |
| 4,588,231 | 5/1986 | Silay et al. | 299/39 |

*Primary Examiner*—Jerome W. Massie
*Assistant Examiner*—Matthew Smith
*Attorney, Agent, or Firm*—Robert F. Hess; Lawrence J. Shurupoff

[57] ABSTRACT

A hydraulic system for a pavement cutting machine controls the engagement and disengagement of a rotating blade with a pavement surface. A proportional-flow manual-release valve is arranged in series with a pressure-compensated maximum-flow control valve to allow a rapid raising of the blade and an initial relatively rapid lowering of the blade followed by a controllable slower blade descent.

6 Claims, 2 Drawing Sheets

PRIOR
ART

BLADE CONTROL SYSTEM FOR CONCRETE CUTTING APPARATUS

BACKGROUND OF THE INVENTION

1. Field Of The Invention

This invention generally concerns pavement cutting apparatus and particularly relates to an electro-hydraulic control system for accurately controlling the engagement and disengagement between a rotating cutting tool and a material being cut.

2. Description Of Prior Developments

A problem has long existed with concrete and pavement cutting saws and the like which use electro-hydraulic systems for raising and lowering a rotating blade. Saw operators prefer to complete their cutting operations in as little time as possible in order to increase their productivity and profitability. As a result, the saw operators wish to lower and raise the cutting blade as quickly as possible at the beginning and end of each cutting path.

Unfortunately, this practice has led to the destruction of many blades and has shortened the life of many engines and transmissions which power the blades. The primary reason for this component failure is the rapid lowering of the blade into the pavement. When the rotating cutting blade is hastily lowered into contact with the pavement the blade engine may easily become overloaded and stall. In addition, the blade may become overstressed so that its cutting elements are sheared away thereby destroying the blade.

Prior blade lowering units have commonly used a battery driven electric motor to power a pump which in turn energized a hydraulic cylinder. The hydraulic cylinder would typically raise the cutting blade and associated blade driving machinery upon receiving pressurized fluid from the pump via an operator-controlled check-and-dump valve. The check-and-dump valve used was either completely open to flow or completely closed to flow so that no control over the rate of blade movement was possible. The blade would be lowered at about the same rate it was raised.

Because an operator usually desires to raise the blade at a rate faster than the rate at which it is lowered, designers have incorporated an additional adjustable valve in the hydraulic line communicating with the cylinder. This adjustable valve included a variable restriction valve arranged in parallel with a one-way check valve. The adjustable valve was set at a fixed setting which determined the maximum rate of blade descent. The check valve would close during the lowering of the blade so that all fluid would pass through the set restriction. However, upon raising the blade, the fluid would flow in the opposite direction so that the check valve arranged in a parallel flow path with the variable restriction would open allowing a rapid actuation of the cylinder. In this manner a rapid raising or lifting of the blade was achieved along with a slow blade descent.

Unfortunately, this solution did not prove entirely satisfactory to the industry since the rate of blade descent, once set, was essentially fixed. In order to reset the adjustable restriction the operator had to access the valve which usually was located in an inconvenient location. Such adjustment was, for practical use, fixed in one position due to its inaccessability.

An unmet need expressed by many operators was for a control which would allow an initial rapid descent of the blade up to a point where the blade closely approached the cutting surface, and then for a slower descent to gently engage the blade with the pavement. This would minimize both raising and lowering time yet prevent damage to the blade, the blade power train, and the blade motor.

One solution to this problem involved the addition of yet another adjustable valve to the hydraulic system. An additional hydraulic line was connected between the reserve or return tank which stores and provides hydraulic fluid to the pump motor and a point in the main fluid line between the check-and-dump valve and the variable restriction valve. A parallel return line was then formed which allowed the variable restriction valve to be set at a relatively higher flow rate than prior systems to enable a more rapid lowering of the blade. As the blade approached the pavement, the operator turned the needle valve in the manner of a rotary faucet valve to further adjust (decrease) the rate of blade descent.

While this system performed generally satisfactorily, it was nevertheless inconvenient for the operator to manipulate since two valves had to be manually controlled, first the check-and-dump valve and then the needle valve. When the blade was adequately lowered using this known system, the operator had to close the needle valve completely to stop the blade descent. This usually distracted the operator and generally was considered as an annoyance, particularly in those cases where numerous short cuts were required.

Accordingly, a need exists for a blade lowering and raising system which may be completely controlled through a single actuator. A need also exists for a fail-safe system which protects the blade and motor regardless of operator error.

SUMMARY OF THE INVENTION

The present invention has been developed to meet the needs described above and therefore has as a primary object the provision of an electro-hydraulic blade engagement system controlled with a single actuator for allowing rapid blade movement in both raising and lowering modes and which incorporates a failsafe feature for protecting the blade, engine, transmission and associated components from overload.

Another object is the provision of a blade control system which facilitates an initial rapid blade descent followed by a slower blade descent upon approaching a cutting surface.

Still another object is to provide a blade control actuator having a substantially linear response such that movement of the actuator is substantially proportional to the flow through the system, up to a predetermined maximum return flow rate.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENTS

Figure 1:
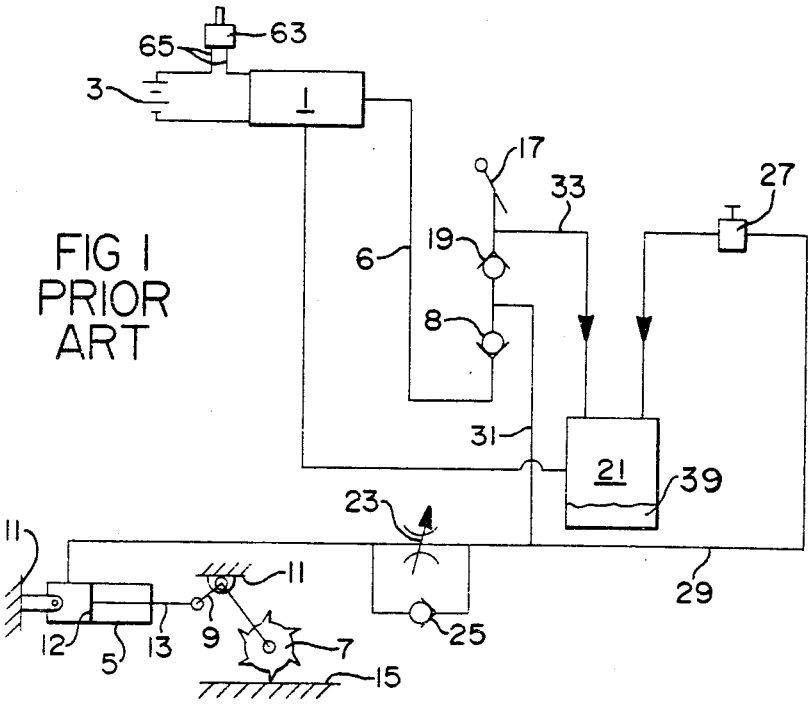
FIG. 1 is a schematic diagram of a known blade control system.
Figure 4:
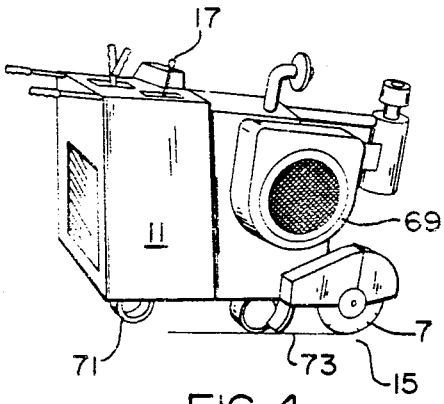
FIG. 4 is a perspective view of a pavement cutting apparatus provided with the blade control system of FIG. 2.

In order to better appreciate the advantages of the present invention a brief discussion of a typical blade control system according to the prior art is of value. Such a known system is shown in FIG. 1 wherein fluid pump 1, powered by a battery 3 drives a hydraulic cylinder 5. Cylinder 5 in turn is connected to a rotating cutting blade 7 via linkage 9. The entire assembly is mounted upon a self-propelled framework 11 such as shown in FIG. 4 and in U.S. Pat. No. 3,417,638 the disclosure of which is incorporated herein by reference.

Figure 3:
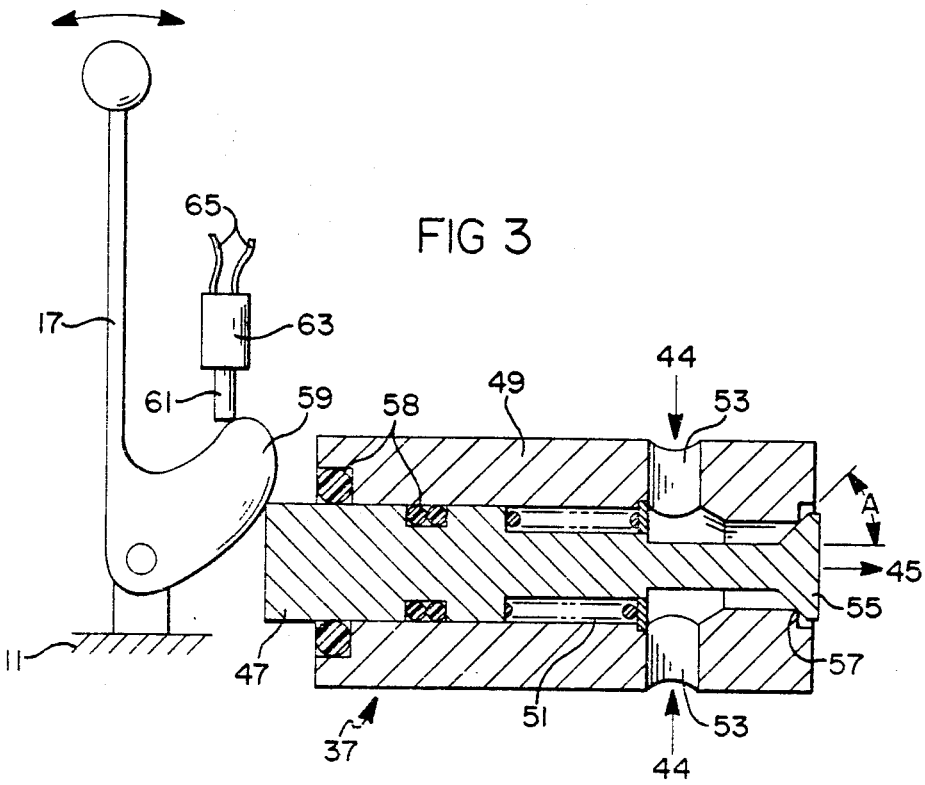
FIG. 3 is a sectional view through the proportional valve.

By pumping fluid into cylinder 5 via hydraulic line 6, check valve 8, hydraulic line 31 and valves 23 and 25, rod 13 will move outwardly. This will cause the blade 7 to lift upwardly from cutting surface 15, typically asphalt or concrete pavement. Cutting power to the pump 1 will, through the conventional valving and switch system of FIG. 1, stop the blade in any desired position. An electric switch 63 linked to the operator's actuator or handle 17 allows the operator to switch power from the battery to the pump to control the raising of the blade. A more detailed view of a similar switching arrangement is seen in FIG. 3, as used with the present invention. While the blade is being raised, valve 19 remains seated.

Once the blade is raised and the power to the pump is switched off via handle 17, the weight of the suspended blade maintains pressure throughout the hyraulic system. Should the operator wish to lower the blade to begin a cutting operation, handle 17 is moved to unseat the check-and-dump valve 19 from its seated position in a conventional manner. Although the stroke of handle 17 may extend over an arc of 3 or 4 inches, a complete opening of valve 19 is achieved with only the first ¼" of handle movement. For practical purposes this results in a valve actuation which is either completely open or completely closed since the valve is too sensitive to provide any meaningful or consistent intermediary flow rates.

After the operator opens valve 19, fluid from cylinder 5 begins to return to tank 21 via an adjustable or variable restriction valve 23. A one-way check valve 25 is arranged in a parallel flow path with valve 23 in such a manner that substantially all the flow into cylinder 5 passes through valve 25 while substantially all the fluid leaving cylinder 5 passes through variable restriction valve 23.

The opening of valve 23 is set at a fixed position which will determine the maximum return flow rate to tank 21 which in turn determines the maximum rate of descent of blade 7. If the blade descent rate is excessive, blade 7 will impact pavement 15 under severe shock load. Accordingly, the maximum descent rate must be fixed at a relatively slow rate to prevent damage to the blade and to prevent overloading and stalling the motor which drives the blade.

Although this system prevents blade damage, it can be frustrating for the operator who must wait while the blade slowly descends from its raised position all the way to the pavement. To remedy this problem, a vernier flow needle valve 27 is arranged in a parallel flow path 29 with valve 19. In addition, the maximum flow rate through variable restriction valve 23 is increased to provide a faster rate of maximum blade descent.

This arrangement allows the operator to rapidly lower blade 7 at its maximum descent rate by opening valve 19 thereby causing fluid from cylinder 5 to return to tank 21 via valve 23, flow line 31, valve 19 and return line 33. Once the blade is sufficiently close to the pavement, the operator closes valve 19 with handle 17. This arrests the movement of the blade. The operator then opens the vernier flow needle valve 27, which is typically closed while valve 19 is open. At this point the blade resumes its descent at a slower rate which is completely and accurately controlled by valve 27.

When the blade has reached its desired depth, the operator closes valve 27 in the manner of a rotary faucet valve and engages a drive system to move the blade along its cutting path through the pavement. Although this system is functional, it requires the operator to actuate two separate valves. In practice this is inconvenient. The operator must first actuate valve 17 then valve 27. This two-step valving operation may distract the operator as it requires the operator to watch the descent of the blade while manipulating two different valves.

Figure 2:
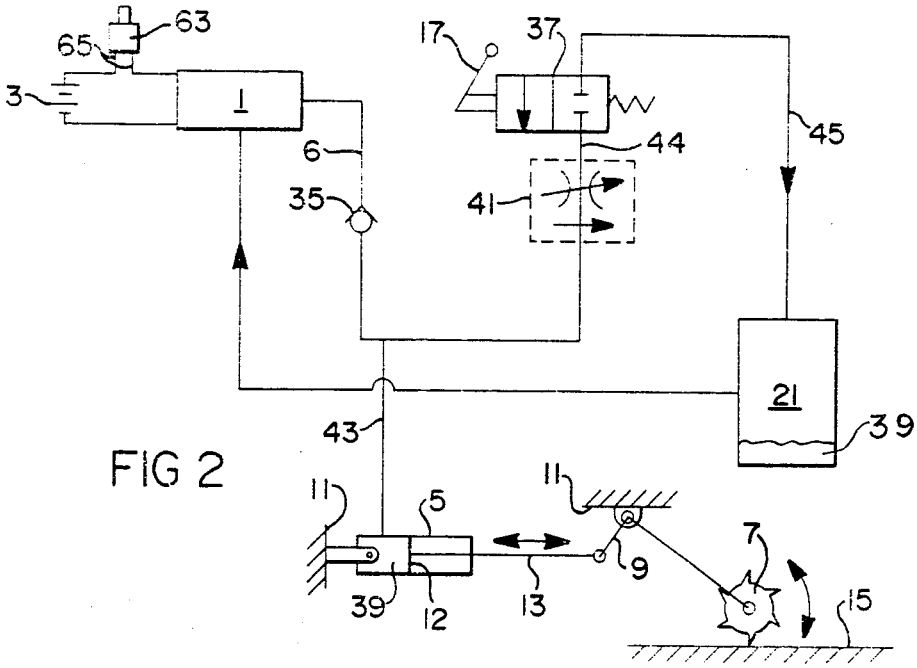
FIG. 2 is a schematic diagram of the blade control system according to the present invention.

In order to provide a more convenient actuation, the control system shown in FIG. 2 has been developed according to the invention. As in the system of FIG. 1, hydraulic pump 1 is powered by battery 3 to force piston 12 to extend rod 13 thereby raising blade 7. However, in the system of FIG. 1, all fluid passes through check valve 35 then directly to cylinder 5. The variable restriction valve 23 and check valve 25 of the prior art are not required. This considerably simplifies the system.

Once the blade is raised, actuator or handle 17 is moved to electrically disconnect battery 3 from pump 1 via an electrical switch connected to the handle as shown in FIG. 3. During raising of the blade, valve 37 remains closed. In order to lower the blade, the operator moves handle 17 to open valve 37 so as to allow the hydraulic fluid 39 to return to tank 21. As check valve 35 prevents the return passage of fluid from the cylinder, all returning fluid flows through valve 41 and valve 37.

Valve 37 is a specially designed proportional valve which linearly meters flow proportionally to the movement of handle 17. Such a valve is also generally referred to as a cam-operated manual-release valve. As the handle is initially actuated, a small amount of hydraulic fluid or oil from cylinder 5 begins to flow through hydraulic line 43, valve 41, valve 37, and hydraulic line 45 to tank 21. Valve 41, which is a pressure-compensated, maximum-flow control valve, is set to provide a predetermined maximum flow rate over a wide variation of flow pressure. Valve 41 is a standard item which is commercially available in varying sizes to suit various applications.

As blade 7 is lowered, valve 41 will limit the return flow through the hydraulic system to a set maximum value regardless of the pressure variations which exist during blade descent. This in turn will set the maximum rate of descent of the blade to a safe rate which will prevent damage to blade and motor caused by excessive shock loading of the blade and blade drive system upon contact with the pavement. Even if the operator completely opens proportional flow valve 37 with handle 17 and leaves valve 37 completely open, the maximum rate of return flow will nevertheless be controlled by valve 41 so that minimal or no damage will result to the blade thereby providing a failsafe feature.

The details of valve 37 are shown in FIG. 3. Actuator or handle 17 is shown in a neutral position which may correspond to the blade being positioned in its raised mode. In order to lower the blade, handle 17 is rotated in a clockwise direction to unseat poppet member 47 from annular valve body 49 against the bias of spring 51. This action allows pressurized hydraulic fluid from line 44 to enter ports 53 which are circumferentially spaced around the valve body 49 in a conventional manner.

The hydraulic fluid then passes between the conical poppet head 55 and the annular valve seat 57. Seal members such as O-rings 58 are provided to seal against leakage. Using standard valve design techniques, the angle A of the poppet head is matched with the contour of cam 59 to provide predetermined flow rates at specified handle locations so that the flow rate from hydraulic line 44 to hydraulic line 45 is substantially proportional to the movement of handle 17. For the system shown, angle A is set at approximately 30° or less. Since this flow fills cylinder 5 and moves piston 12, the rate of movement of blade 7 is also substantially proportional to the movement of handle 17.

By moving handle 17 in a counterclockwise direction, plunger 61 of switch 63 is actuated to complete a circuit 65 between the battery 3 and pump 1. If the blade is in a lowered position, it will be raised upon completion of circuit 65 as the pump sends pressurized fluid to cylinder 5 to actuate piston 12 as described above. By completely controlling the blade movement with one actuator, a convenient and efficient system results.

An example of a self-propelled pavement cutting apparatus adapted with the system of FIGS. 2 and 3 is shown in FIG. 4. In use, an operator will lower the rotating blade at an initial rapid rate by moving handle 17 to its extreme or fully actuated position. This will cause the blade to be initially rapidly lowered toward the pavement as a maximum return flow is achieved through valves 41 and 37. As the blade approaches the pavement, the operator slowly returns the handle 17 toward its neutral (no flow) position shown in FIG. 3 thereby gradually decreasing flow through the system and gradually decreasing the rate of blade descent. After the blade contacts pavement 15, motor 69 is coupled to drive wheels 71 to effect cut 73 as seen in FIG. 4.

This arrangement allows a very quick raising of the blade from the pavement and a relatively quick blade descent with a failsafe feature. Moreover, by providing an actuator with a handle movement substantially linearly proportional to the rate of blade descent a very convenient system results. Overall cutting times are significantly reduced while the control of blade movement is enhanced. The proportional flow valve 37 provides a very desirable "feel" or sense of fine control throughout blade engagement and disengagement. This feature is particularly appreciated by operators accustomed to prior art designs.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic control system for pavement cutting apparatus and the like, comprising:

a hydraulic cylinder having a piston for moving a tool into and out of contact with a working surface;

pump means for pressurizing said cylinder with hydraulic fluid in order to move said piston and said tool;

switch means operatively associated with said pump means for selectively energizing said pump means;

a proportional flow valve arranged in fluid communication with said cylinder for controlling flow rate of said fluid from said cylinder through said proportional flow valve; and a valve actuator operatively connected to said proportional flow valve and operatively connected to said switch means such that movement of said actuator selectively operates said pump means and selectively operates said switch means and wherein movement of said actuator is substantially proportional to the flow rate of said hydraulic fluid from said cylinder through said proportional flow valve such that movement of said actuator is substantially proportional to the rate of movement of said piston so as to provide accurate control of tool movement.

2. The system of claim 1, further comprising a pressure-compensated maximum-flow control valve arranged in fluid communication with said cylinder for limiting to a maximum predetermined value said flow rate of said hydraulic fluid through said proportional flow valve.

3. The system of claim 2 further comprising a one-way check valve arranged in fluid communication with said pump means and with said cylinder for allowing substantially unrestricted flow of said fluid into said cylinder and for channelling substantially all flow of said fluid from said cylinder through said pressure compensated maximum-flow control valve.

4. The system of claim 3, further comprising a hydraulic fluid return tank arranged in fluid communication with said pump and with said proportional flow valve.

5. The system of claim 4, wherein said system is mounted upon a self-propelled framework of a pavement cutting machine.

6. A hydraulic control system for pavement cutting apparatus and the like, comprising:

a hydraulic cylinder having a piston for moving a tool into and out of contact with a working surface;

pump means for pressurizing said cylinder with hydraulic fluid in order to move said piston and said tool;

switch means operatively associated with said pump means for selectively energizing said pump means;

a proportional flow valve arranged in fluid communication with said cylinder for controlling flow rate of said fluid from said cylinder through said proportional flow valve; and a valve actuator having a cam which is operatively connected to said proportional flow valve and operatively connected to said switch means such that movement of said actuator selectively operates said pump means and selectively operates said switch means and wherein movement of said actuator is substantially proportional to the flow rate of said hydraulic fluid from said cylinder through said proportional flow valve such that movement of said actuator is substantially proportional to the rate of movement of said piston so as to provide accurate control of tool movement.

* * * * *